United States Patent [19]

Smolinski

[11] 4,187,693

[45] Feb. 12, 1980

[54] CLOSED CHAMBER ROTARY VANE GAS CYCLE COOLING SYSTEM

[76] Inventor: Ronald E. Smolinski, 4081 Forest Ridge, Dayton, Ohio 45424

[21] Appl. No.: 915,707

[22] Filed: Jun. 15, 1978

[51] Int. Cl.[2] ..... F25D 9/00

[52] U.S. Cl. ..... 62/402; 418/85; 123/119 CD

[58] Field of Search ..... 62/402, 499, 86; 418/85, 86; 123/119 CD

[56] References Cited

U.S. PATENT DOCUMENTS

| | | | |
|---|---|---|---|
| 3,686,893 | 8/1972 | Edwards | 62/402 |
| 4,021,163 | 5/1977 | Morita et al. | 418/83 |
| 4,117,695 | 10/1978 | Hargreaves | 62/499 |

*Primary Examiner*—Ronald C. Capossela

*Attorney, Agent, or Firm*—Joseph E. Rusz; Richard J. Killoren

[57] ABSTRACT

A gas cycle cooling system having a rotary compressor and expander driven by a common shaft wherein the compression and expansion of a modified reverse Brayton cycle is provided within a closed chamber by changes in volume brought about by vanes sliding within slots in a rotor. The rotor is positioned within the chamber to provide spaces between the rotor and the chamber wall which act as effective gas transfer passages between the compressor and the expander. Liquid from a first heat exchanger is circulated through the wall of the rotor housing adjacent the compressor portion of the chamber to remove heat during the compressor phase of the cycle. Liquid is circulated through the wall of the rotor housing adjacent the expander portion of the chamber to provide cooling for a second heat exchanger.

5 Claims, 2 Drawing Figures

CLOSED CHAMBER ROTARY VANE GAS CYCLE COOLING SYSTEM

RIGHTS OF THE GOVERNMENT

The invention described herein may be manufactured and used by or for the Government of the United States for all governmental purposes without the payment of any royalty.

BACKGROUND OF THE INVENTION

The patents to Edwards, U.S. Pat. Nos. 3,686,893; 3,913,351; and 3,977,852 describe cooling systems which operate on the reverse Brayton cycle. In conventional rotary vane reverse Brayton cycle refrigeration systems, air is supplied to the compressor portion of a sliding vane rotary air cycle device wherein the air undergoes isentropic compression. The air then passes through a heat exchanger wherein it undergoes a constant pressure cooling. The high pressure air then passes to the expander portion of the rotary air cycle device wherein it undergoes a reversible expansion after which it passes through a second heat exchanger wherein it picks up heat at a constant pressure.

In these systems the air must pass through inlet and outlet ports in the rotary air cycle device thereby increasing the losses in the system.

BRIEF SUMMARY OF THE INVENTION

According to this invention, a sliding vane rotary gas cycle device is provided wherein there is an internal transfer of the working gas between the output of the compressor and the input of the expander and between the output of the expander and the input of the compressor thereby eliminating port losses. Also, heat transfer is provided during the compression portion of the cycle and the expansion portion of the cycle by providing an air to liquid heat exchanger adjacent the compressor and a liquid to air heat exchanger adjacent the expander to further increase the coefficient of performance of the system.

IN THE DRAWING

DETAILED DESCRIPTION OF THE INVENTION

Figure 1:
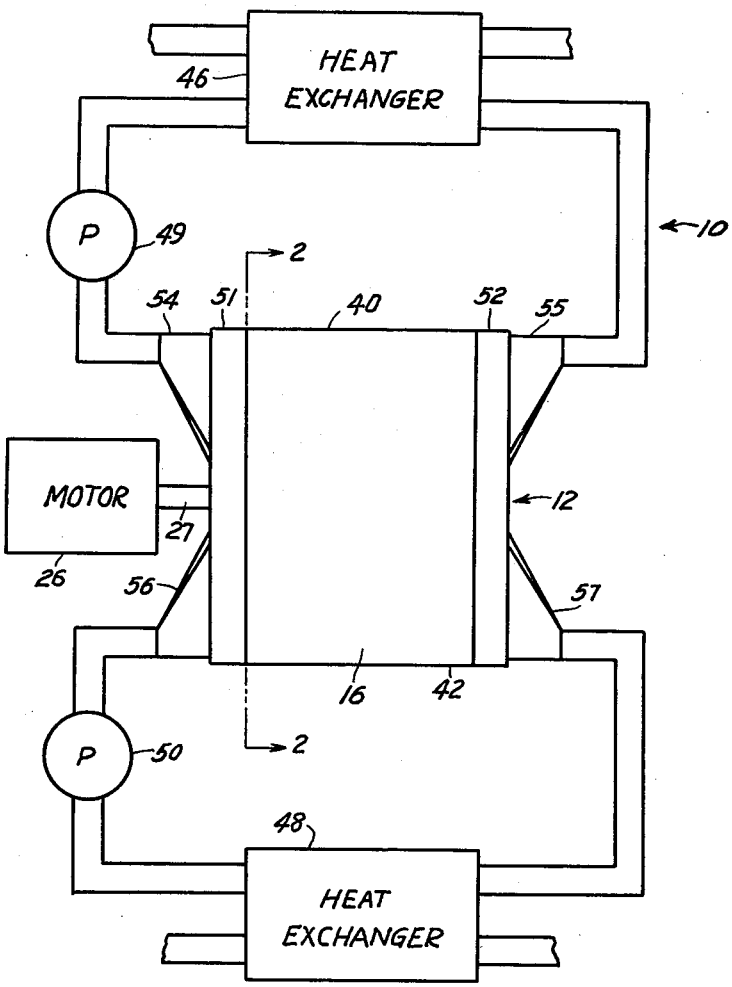
FIG. 1 is a partially schematic view of a sliding vane rotary gas cycle cooling apparatus according to the invention.
Figure 2:
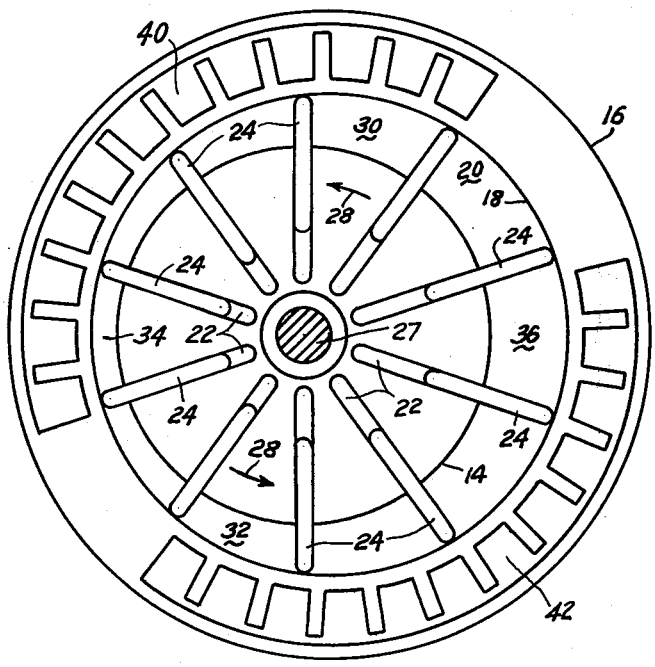
FIG. 2 is a partially schematic enlarged sectional view of the device of FIG. 1 along the line 2—2.

Reference is now made to FIG. 1 of the drawing which shows a rotary vane gas cycle cooling system 10 having a rotary vane compressor-expander apparatus 12, including a rotor 14, shown in FIG. 2. The rotor 14 is positioned within a housing 16 which forms the wall 18 of a closed chamber 20. The rotor 14 includes a plurality of radial slots 22 with a slidable vane 24 in each of the slots as in conventional rotary vane air cycle machines. Any conventional vane guide means, not shown, may be provided.

The rotor is driven by a motor 26, connected to shaft 27, shown in FIG. 1. With the direction of rotation as shown by arrows 28, the side 30 of chamber 20 will act as a compressor and the side 32 will act as an expander. The gas used within chamber 20 would be determined by the particular application and in some applications the gas used would be air.

In the normal reverse Brayton cycle apparatus, the heat exchanger between the output of the compressor and the inlet to the expander acts as a transfer passage between the compressor and the expander. The heat exchanger connected between the output of the expander and the inlet to the compressor acts as a transfer passage between the expander and the compressor.

In the device of the invention, the axis of rotation of the rotor 14 is displaced from the axis of the chamber 20 with the rotor being placed from the wall 18 to provide an effective transfer passage 34 between the compressor and the expander within the housing 16. The space between the rotor and wall 18 provides an effective transfer passage 36 between the expander and the compressor. The sizes of passages 34 and 36 are determined by the position of the rotor within chamber 20 which would be selected according to the compression ratio desired.

A gas to liquid heat exchanger 40 is provided adjacent the compressor side 30 of chamber 20 and a liquid to gas heat exchanger 42 is provided adjacent the expander side 32 of chamber 20. The liquid used in heat exchangers 40 and 42 may be water or other known coolants. The liquid in heat exchanger 40 passes through a heat rejection heat exchanger 46. Liquid cooled in the heat exchanger 42 picks up heat in heat exchanger 48 to provide cooling in an environmental control system for aircraft; for example, a fighter aircraft. The liquid is circulated through the heat exchangers by pumps 49 and 50. End members 51 and 52, shown in FIG. 1, seal the ends of chamber 20. The end members 50 and 52 include manifolds 54, 55, 56 and 57 for supplying liquid to the heat exchangers 40 and 42 from heat exchangers 46 and 48 and from heat exchangers 40 and 42 to heat exchangers 46 and 48.

In the operation of the device of the invention, the compression and expansion of the gas within chamber 20 is the same as in prior art rotary vane air cycle machines. Since the gas is not removed from chamber 20, the exhaust and intake portions of the normal reverse Brayton cycle is not required. Heat is removed from the gas in heat exchanger 40 during compression, thus requiring less work by the motor 26 during the compression portion of the cycle. Heat from heat exchanger 40 is rejected in heat exchanger 46. Heat added to the liquid in heat exchanger 48 is given up to the gas in heat exchanger 42 during the expansion portion of the cycle. Since less work is required for the same amount of cooling due to the extraction of heat during compression and the addition of heat during expansion together with the elimination of inlet and exit losses, the coefficient of performance is increased.

While a liquid has been disclosed as the cooling fluid used in the heat exchangers 40 and 42, dense gases may be desirable for some applications.

There is thus provided an improved rotary vane air cycle system which eliminates port losses and increases the performance of the system.

I claim:

1. A rotary vane gas cycle cooling system, comprising: a compressor and an expander driven by a common shaft, said compressor and expander including a rotor, rotatably mounted on said shaft; said rotor having radially slidable vanes which form a plurality of cells which change in volume as the rotor rotates; said rotor being positioned within a closed chamber with said shaft being displaced from the center of said chamber; means for cooling the gas in said compressor and means for adding heat to the gas in said expander.

2. The device as recited in claim 1 wherein said means for cooling the gas in said compressor includes a first heat exchanger in the wall of said chamber adjacent the compressor and said means for adding heat to the gas in said expander includes a second heat exchanger in the wall of said chamber adjacent the expander.

3. The device as recited in claim 2 wherein said means for cooling the gas in said compressor includes third heat exchanger; a cooling liquid in said first and said third heat exchangers and means for circulating the cooling liquid between the first and the third heat exchangers.

4. The device as recited in claim 3 wherein said means for adding heat to the gas in said expander includes an environmental control heat exchanger; a cooling liquid in said second heat exchanger and said environmental control heat exchanger and means for circulating the cooling liquid between the environmental control heat exchanger and the second heat exchanger.

5. The device as recited in claim 4 including means for providing a first effective transfer passage within the housing between the compressor and the expander and means for providing a second effective transfer passage within the housing between the expander and the compressor.

* * * * *